US011410485B2

(12) United States Patent
Shigeta

(10) Patent No.: US 11,410,485 B2
(45) Date of Patent: Aug. 9, 2022

(54) CARD GAME MONITORING SYSTEM

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

(21) Appl. No.: 15/998,000

(22) Filed: Jun. 5, 2018

(65) Prior Publication Data

US 2018/0286170 A1 Oct. 4, 2018

Related U.S. Application Data

(63) Continuation of application No. 15/112,038, filed as application No. PCT/JP2015/000171 on Jan. 16, 2015, now Pat. No. 11,145,158.

(30) Foreign Application Priority Data

Jan. 17, 2014 (AU) ..... 2014200314

(51) Int. Cl.
*G07F 17/32* (2006.01)

(52) U.S. Cl.
CPC ..... *G07F 17/3206* (2013.01); *G07F 17/322* (2013.01); *G07F 17/3237* (2013.01);
(Continued)

(58) Field of Classification Search
CPC ..... G07F 17/3206; G07F 17/322; G07F 17/3248; G07F 17/3276; G07F 17/3293
(Continued)

(56) References Cited

U.S. PATENT DOCUMENTS 4,531,187 A 7/1985 Uhland
5,781,647 A 7/1998 Fishbine et al.
(Continued)

FOREIGN PATENT DOCUMENTS

AU 2012201094 A1 3/2012
CA 2543251 A1 10/2000
(Continued)

OTHER PUBLICATIONS

Office Action dated Jul. 13, 2018 for U.S. Appl. No. 15/112,038.
(Continued)

*Primary Examiner* — Omkar A Deodhar
*Assistant Examiner* — Shauna-Kay Hall
(74) *Attorney, Agent, or Firm* — Norton Rose Fulbright US LLP

(57) ABSTRACT

The card game monitoring system comprises a game table on which bettors put wagers on betting areas; and a card shooter apparatus has a card reading unit to read and record the number (rank) and suit of the cards; and a control unit to determine a winning hand according to a table game rules based on information of numbers (ranks) and suits of the cards sequentially read by the card reading unit; a monitor video camera system to capture positions of cards and to identify wagers on each betting area at the game table; the control unit has further processing function to check whether wagers with payoff move to a pool of the winner of the bettors determined by the card shooter apparatus at the end of each game.

23 Claims, 2 Drawing Sheets

(52) U.S. Cl.
CPC ..... *G07F 17/3241* (2013.01); *G07F 17/3248* (2013.01); *G07F 17/3276* (2013.01); *G07F 17/3293* (2013.01)

(58) Field of Classification Search
USPC ..... 463/25
See application file for complete search history.

(56) References Cited

U.S. PATENT DOCUMENTS 6,093,103 A 7/2000 McCrea
6,117,012 A 9/2000 McCrea
6,460,848 B1 10/2002 Soltys et al.
6,514,140 B1 2/2003 Storch
6,582,301 B2 6/2003 Hill
6,848,994 B1 * 2/2005 Knust ..... G06Q 20/04 273/148 R
6,908,385 B2 6/2005 Green
8,337,296 B2 12/2012 Grauzer et al.
2002/0042298 A1 * 4/2002 Soltys ..... G07F 17/3251 463/29
2002/0045476 A1 4/2002 Poole et al.
2002/0045479 A1 * 4/2002 Soltys ..... G06Q 10/0639 463/29
2002/0089120 A1 7/2002 Miller
2002/0123376 A1 9/2002 Walker et al.
2002/0155869 A1 10/2002 Soltys et al.
2003/0064798 A1 4/2003 Grauzer et al.
2003/0087696 A1 5/2003 Soltys et al.
2003/0195025 A1 10/2003 Hill
2003/0232651 A1 12/2003 Huard et al.
2005/0012270 A1 1/2005 Schubert
2005/0026680 A1 * 2/2005 Gururajan ..... A63F 1/14 463/25
2005/0051965 A1 * 3/2005 Gururajan ..... A63F 1/14 273/292
2005/0062226 A1 3/2005 Schbert et al.
2005/0137005 A1 * 6/2005 Soltys ..... A63F 1/18 463/13
2005/0148391 A1 7/2005 Tain
2005/0258597 A1 11/2005 Soltys et al.
2005/0272501 A1 * 12/2005 Tran ..... G07F 17/3241 463/29
2005/0288086 A1 * 12/2005 Schubert ..... G07F 17/32 463/11
2006/0027970 A1 2/2006 Kyrychenko
2006/0063577 A1 3/2006 Downs, III
2006/0160608 A1 * 7/2006 Hill ..... G07F 17/3293 463/25
2006/0177109 A1 8/2006 Storch
2006/0183540 A1 8/2006 Grauzer et al.
2006/0199649 A1 * 9/2006 Soltys ..... G06Q 10/0639 463/47
2006/0202422 A1 * 9/2006 Bahar ..... G07F 17/32 273/274
2006/0217199 A1 * 9/2006 Adcox ..... G07F 17/3223 463/40
2006/0252521 A1 * 11/2006 Gururajan ..... A63F 1/00 463/29
2007/0015583 A1 1/2007 Tran
2007/0049369 A1 3/2007 Kuhn et al.
2007/0111773 A1 * 5/2007 Gururajan ..... G07F 17/32 463/11
2007/0117604 A1 5/2007 Hill
2007/0178955 A1 8/2007 Mills
2008/0113783 A1 * 5/2008 Czyzewski ..... A63F 3/00157 463/29
2008/0143048 A1 * 6/2008 Shigeta ..... A63F 1/14 273/149 R
2008/0180250 A1 * 7/2008 Steil ..... A63F 1/06 340/572.1
2008/0303210 A1 12/2008 Grauzer et al.
2009/0075725 A1 * 3/2009 Koyama ..... G07F 17/32 463/25
2009/0104961 A1 4/2009 Hamada et al.
2009/0121434 A1 5/2009 Baerlocher et al.
2009/0131151 A1 * 5/2009 Harris ..... G07F 17/32 463/22
2009/0140492 A1 6/2009 Yoseloff et al.
2009/0143141 A1 6/2009 Wells et al.
2009/0176546 A1 7/2009 Kyrychenko
2009/0191933 A1 7/2009 French
2009/0233699 A1 * 9/2009 Koyama ..... G07F 17/3232 463/25
2009/0273141 A1 * 11/2009 Bahar ..... G07F 17/32 273/274
2010/0016050 A1 1/2010 Snow et al.
2010/0109244 A1 5/2010 Low
2010/0207324 A1 8/2010 Soltys et al.
2010/0244382 A1 9/2010 Snow
2011/0052049 A1 * 3/2011 Rajaraman ..... G06T 7/90 382/165
2011/0079959 A1 4/2011 Hartley
2011/0127722 A1 * 6/2011 Emori ..... G07F 17/32 273/274
2011/0227703 A1 * 9/2011 Kotab ..... G07F 17/32 340/10.1
2012/0080845 A1 4/2012 Emori et al.
2012/0231866 A1 * 9/2012 Witty ..... G07F 11/32 463/17
2012/0252564 A1 * 10/2012 Moore ..... G07F 17/322 463/25
2013/0109455 A1 5/2013 Grauzer et al.
2013/0307215 A1 11/2013 Shigeta
2014/0094239 A1 4/2014 Grauzer et al.
2015/0087417 A1 * 3/2015 George ..... G07F 17/3237 463/31
2015/0375096 A1 12/2015 Jackson et al.

FOREIGN PATENT DOCUMENTS

CN 101687112 A 3/2010
CN 102125756 A 7/2011
CN 102892472 A 1/2013
CN 103418128 A 12/2013
EP 2545967 A2 1/2013
EP 2613298 A1 7/2013
JP 2012075781 A 4/2012
MO I001207 A 11/2013
TW 201200214 A 1/2012
WO 98/33566 A1 8/1998
WO 01/91866 A1 12/2001
WO 2005/025701 A2 3/2005

OTHER PUBLICATIONS

Office Action dated Jul. 26, 2018 for U.S. Appl. No. 15/894,090.
International Application No. PCT/JP2015/000171, International Search Report and Written Opinion dated Mar. 27. 2015.
Written Opinion of the Intellectual Property Office of Singapore dated Jul. 10, 2017 issued in corresponding Singapore Application No. 11201605347T.
Search Report of the Intellectual Property Office of Singapore dated Jul. 7, 2017 completed in corresponding Singapore Application No. 11201605347T.
Office Action dated Dec. 1, 2017 for EP Application 15701853.2.
Office Action dated Jun. 29, 2017 for New Zealand Application 721845.
Office Action dated Sep. 8, 2017 for parent application, U.S. Appl. No. 15/112,038.
Office Action dated Jul. 13, 2018 for parent application, U.S. Appl. No. 15/112,038.
Singaporean Office Action dated May 13, 2019 for SG Application No. 10201801579R.
Examination Report for AU Application No. 2018203865 dated Aug. 14, 2019.
Final Action for U.S. Appl. No. 16/000,056 dated Aug. 20, 2019.
Search Report & Written Opinion for SG Application No. 10201804982S dated Aug. 21, 2019.

(56) References Cited

OTHER PUBLICATIONS

Office Action for U.S. Appl. No. 15/894,090 dated Sep. 20, 2019.
Office Action for U.S. Appl. No. 15/112,038 dated Sep. 20, 2019.
U.S. Office Action dated Jun. 26, 2020 issued in corresponding U.S. Appl. No. 15/894,090 cites the patent documents above.
U.S. Notice of Allowance dated Jan. 13, 2021 issued in U.S. Appl. No. 16/000,056 cites the patent documents above.
U.S. Final Office Action dated Nov. 10, 2020 issued in U.S. Appl. No. 16/150,378 cites the patent document above.
Chinese Office Action dated Jun. 9, 2021 issued in CN Application No. 202010076775.2 cites the patent documents above.
Chinese Office Action dated Jun. 9, 2021 issued in CN Application No. 202010076776.7 cites the patent documents above.
Chinese Office Action dated Jun. 23, 2021 issued in CN Application No. 202010076770.X cites the patent documents above.
U.S. Office Action dated Jan. 10, 2019 for U.S. Appl. No. 15/112,038.
U.S. Office Action dated Jan. 10, 2019 for U.S. Appl. No. 15/894,090.
European Search Report dated Sep. 25, 2018 for EPApplication 18187764.8.
Chinese Office Action dated Jan. 3, 2020 issued in corresponding CN Application No. 201810096721.5 cites the patent documents above.
JP Decision of Dismissal of Amendment dated Apr. 12, 2022 issued in JP Application No. 2020-178113.
Chinese Office Action dated Mar. 21, 2022 issued in CN Application No. 201810096721.5.

* cited by examiner

CARD GAME MONITORING SYSTEM

CROSS-REFERENCE TO RELATED APPLICATION

The present application is a continuation from U.S. application Ser. No. 15/112,038 filed Jul. 15, 2016, which is a 35 USC § 371 national phase application from International Application No. PCT/JP2015/000171 filed Jan. 16, 2015, which claims priority to AU Application No. 2014200314 filed Jan. 17, 2014, each of which is hereby incorporated by reference in its entirety.

TECHNICAL FIELD

The present invention relates to a table game monitoring system for a table game using playing cards from a shoe having multiple decks that have been shuffled together prior to the beginning of play in which bettors make wagers on betting areas of a game table in front of the bettors. This table game monitoring system monitors whether or not wagers of winning bettor(s) move to appropriate area of the winner(s).

BACKGROUND ART

Baccarat and Black Jack are of the many live table games played in casinos or gaming establishments. These games use a standard deck of 52 playing cards and are usually dealt from a shoe having multiple decks (6 to 9 or 10 decks) that have been shuffled together prior to the beginning of play. When operating people (hereinafter "the dealer") in casinos deliver playing cards to a game table for plays in such games, any loss of cards or exchange of cards between bettors, etc. should not occur, and also wagers with payoffs must correctly go to the winners of the bettors after each game has ended.

To assure fair games by preventing such loss or exchanges during games, the game tables in casinos should be administrated so that games at tables are played properly (i.e. there is no exchange of cards or any other accidental or fraudulent acts etc.) and wagers are correctly paid off to the winners. A system to monitor the game tables by camera is known and is disclosed in Patent Literature 1: (U.S. Pat. No. 6,582,301). This known system only monitors the table game and records whole games for later analysis if it is believed that some inappropriate act has occurred.

CITATION LIST

U.S. Pat. No. 6,582,301B

SUMMARY OF INVENTION

The present invention provides a real-time monitoring of the table game and enables the casino to stop an ongoing game immediately when something unexpected happens by administrating the whole game from the start to the end of the game.

The present invention has been made in view of the above problem, and aims to provide a table game monitoring system with which it is possible to allow a casino to stop an ongoing game immediately when something unexpected happens by administrating the whole game from the start to the end of the game and during payoffs.

To solve the above conventional problems, the present invention provides the card game monitoring system having:

a game table on which bettors make wagers on betting areas, a card shooter apparatus that is put on the game table and has a card reading unit that reads the number (rank) of the card and having a control unit to determine a winning hand according to a table game rules based on information of numbers of the cards sequentially read by the card reading unit and a monitor video camera system to capture positions of the card delivered from the card shooter apparatus to bettors and identify wagers on each betting area at the game table, the control unit has a processing function using the information of the monitor video camera system to determine: 1) head-count of the bettors playing each game by identifying the wagers on each betting area or cards delivered to bettors, 2) whether or not each bettor gets more than two cards from the card shooter apparatus, 3) each hand of the bettors and the dealer according to the information read by the card shooter apparatus using the information of head-count of the bettors according to the game rule, and 4) the winner(s) having the winning hand(s) in the game according to the game rule based on the information of the each hand of the bettors and the dealer, wherein the monitor video camera system further reads movements of wagers on the game table, and the control unit having further processing function to check whether wagers with payoffs move to the winner of the bettor determined by the card shooter apparatus at the end of each game.

In the card game monitoring system, the control unit has further processing function to identify ranks of playing cards on the game table delivered by a dealer and to check and report whether ranks of cards are the same as the ones determined by the card shooter apparatus.

DESCRIPTION OF EMBODIMENTS

Figure 1:
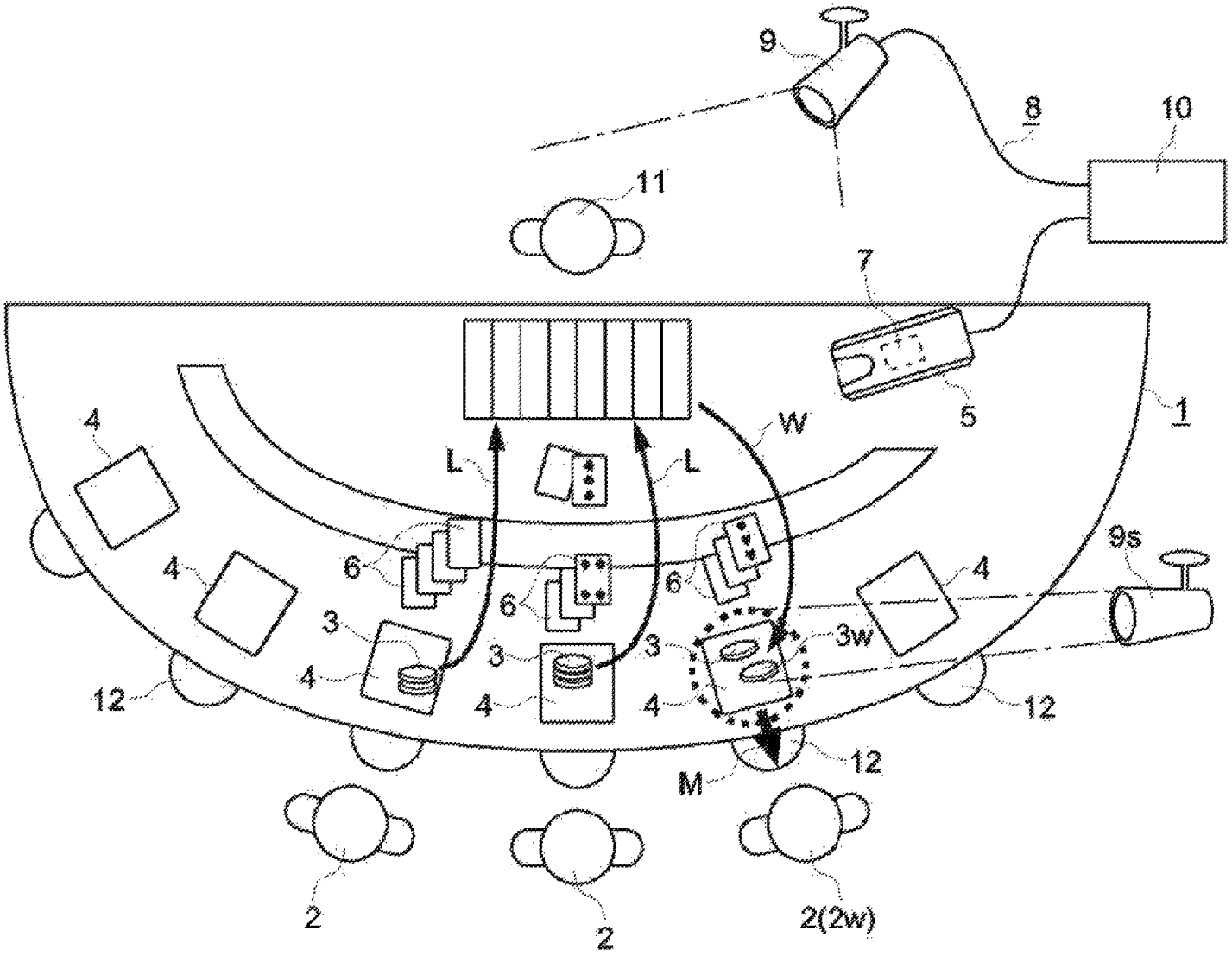
FIG. 1 is a diagram schematically showing the entirety of a table game system according to an embodiment 1 of the present invention.

Embodiment 1 of the present invention will be described with reference to the attached drawings. Embodiment 1 of the present invention provides a card game monitoring system for playing Black Jack. In FIG. 1, the card game monitoring system has: a game table 1 on which bettors 2 make wagers by putting wagers 3 on betting areas 4; a card shooter apparatus that is put on the game table 1 and has a card reading unit that reads the number (rank) and suit of the cards 6 and having a control unit 7 to determine a winning hand according to a table game rule based on information of numbers (ranks) of the cards sequentially read by the card reading unit 5.

A monitor video camera system 8 which has several cameras 9 is set above each game table 1 to capture the positions of cards 6 delivered from the card shooter apparatus 5 to bettors 2. The monitor video camera system 8 identifies wagers 3 on each betting area 4 at the game table 1, the control unit 10 has a processing function using the information of the monitor video cameras 9 to determine the following: 1) head-count of the bettors playing on each game by identifying the positions of wagers on each betting area or cards delivered to each bettor 2 (three persons (heads) shown in FIG. 1), 2) number of cards delivered for each bettor 2 by dealer 11 from the card shooter apparatus 5 (whether or not each bettor 2 gets more than two cards).

The control unit 10 has further processing function using information from the monitor video cameras 9 to determine each hand of the bettors 2 and the dealer 11 according to the information read by the card shooter apparatus 5 using the information of the results of head-counting of the bettors 2 and according to the game rules installed in the control unit 7 of the card shooter apparatus 5. Then the control unit 7 will determine the winner W having the winning hand on the game based on the information of the hands of the bettors 2 and the dealer 11.

Wherein the card shooter apparatus 5 knows directions of each card (who gets each card read by the card shooter apparatus 5 through the monitor video camera system 8) and then the card shooter apparatus 5 (the control unit 7) will figure out by its programs the hands held by the bettors 2 and the dealer 11. The control unit 10 has further a processing function to check whether wagers 3 with payoffs 3W move to a pool 12 of the winner 2W of the bettors 2 determined by the card shooter apparatus 5 at the end of each game (the movement M for the winners and L for loser in FIG. 1).

The monitor video camera system 8 (with the control unit 10) has further processing function that identify ranks of playing cards 6 by analyzing pictures from the monitor video cameras 9 to determine each hand (number) of the bettors 2 on the game table delivered by a dealer 11 and checks whether suits and ranks of cards 6 are the same as the ones read and determined by the card shooter apparatus 5.

The monitor video camera system 8 (the control unit 10) has further processing function that identifies total amounts of wagers 3 by counting chips on each betting area 4 of the bettors 2. Each total amount of wagers 3 are calculated by analyzing pictures from the monitor video cameras 9 of its colors and its height of chips on each betting areas 4. Special video cameras 9*s* for this purpose may be put around the game table 1 to take side views of the chips of wagers 3.

Figure 2:
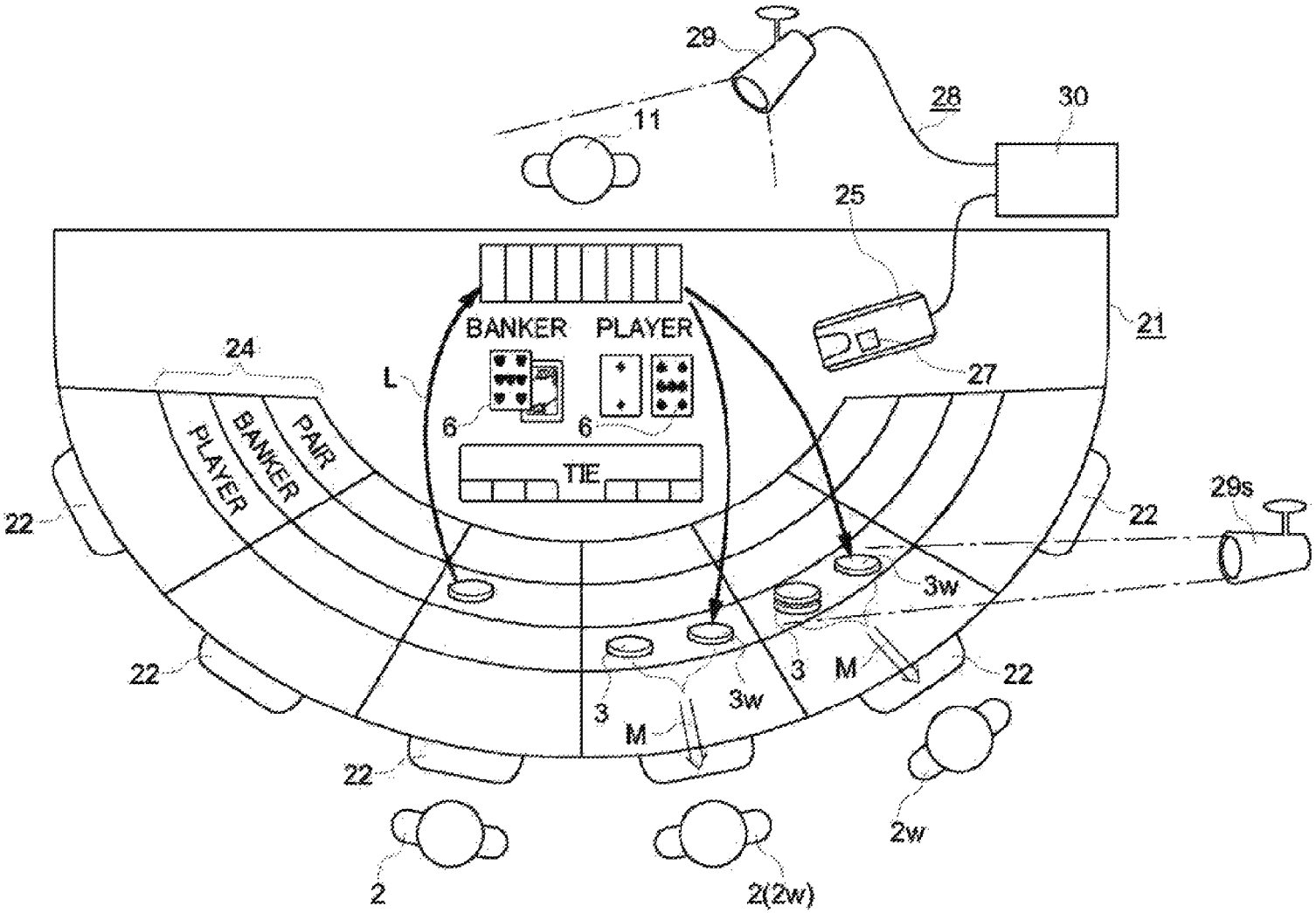
FIG. 2 is a diagram schematically showing the entirety of a table game system according to an embodiment 2 of the present invention.

FIG. 2 shows an example of Embodiment 2 of the present invention. Embodiment 2 of the present invention provides a card game monitoring system for playing game (Baccarat). In FIG. 2, the card game monitoring system has: a game table 21 on which bettors 2 make wagers by putting wagers 3 on betting areas 24; a card shooter apparatus 25 that is put on the game table 21 and has a card reading unit that reads the number (rank) and suit of the cards 6 and having a control unit 27 to determine a winning hand according to a table game rule based on information of numbers (ranks) of the cards 6 sequentially read by the card shooter apparatus 25.

A monitor video camera system 28 reads cards and movements of the wagers 3 on the game table. The control unit 27 of the card shooter apparatus 25 has processing functions to determine whether the winning hand is the Banker or the Player based on information of numbers (ranks) of the cards read by the a card shooter apparatus 25 and Baccarat game rule in the control unit 27. A control unit 30 of the card game monitoring system having processing function to check whether wagers 3 with payoffs 3W move to a pool 22 of the winners 2W of the bettors 2 after each game has ended.

Wherein the card shooter apparatus 25 knows that place (Banker or Player) to which each card is delivered according to the game rule of Baccarat and then the card shooter apparatus 25 (with the control unit 27) will calculate each hand of Banker and Player. In this way the card shooter apparatus 25 determines whether a winning hand is the Banker or the Player. The control unit 30 has a further processing function to check whether wagers 3 with payoffs 3W move to a pool 22 of the winner 2W of the bettors 2 determined by the card shooter apparatus 25 at the end of each game (the movement M for the winners and L for loser movement M in FIG. 2).

The monitor video camera system 28 (with the control unit 30) has further processing function that identify ranks of playing cards 6 on the game table 21 delivered by a dealer 11 by analyzing pictures obtained from the monitor video cameras 29. This card game monitoring system checks whether suits and ranks of cards 6 are the same as the ones read and determined by the card shooter apparatus 25 and reports to an administration section of the casino the results of whether the suits and ranks of cards 6 are the same as those delivered and read by the card shooter apparatus 25.

The monitor video camera system 28 (the control unit 30) has further processing function that identify total amounts of wagers 3 by counting chips on each betting area 24 of the bettors 2. Each total amount of wagers 3 is calculated by analyzing pictures from the monitor video cameras 29 of its colors and its height of chips on each betting areas 24. Special video cameras 29*s* for this purpose may be put around the game table 21 to take side views of the chips of wagers 3.

In both examples of Embodiment 1 and 2 the monitor video camera system 8 and 28 can identify positions of wagers 3, the total amount of wagers 3 of its colors and its height of chips on each betting areas 4 and 24 by analyzing pictures taken by the video cameras 9, 9*s*, 29 and 29*s* using CCD and through known technology of vision analysis. The monitor video camera system 8 and 28 can also identify positions of cards 3 and analyze the faces of cards showing in betting.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Annex 1

The card game monitoring system mentioned above, the card shooter apparatus has further determination function of the card games when each game starts and ends according to the rules of Baccarat or Black Jack with monitoring video camera system.

Annex 2

The card game monitoring system mentioned above, the control unit has further processing function to check whether wagers do not move from the original betting position to the other area during the each game starts and ends (during each game).

Annex 3

The card game monitoring system mentioned above, the control unit has a determination function to determine when the betting starts before the start of each game (the betting start indicates the time the first bet is put on the betting area).

Annex 4

The card game monitoring system mentioned above, the control unit has a determination function to determine when the betting ends before the start of each game (the betting end indicates the time the first card is delivered from the card shooter apparatus). Also the control unit has a processing function using the information from the monitor video camera system to determine the movement of the dealer's hand representing the end of betting called "No more bet".

Annex 5

The card game monitoring system mentioned above, the control unit has a determination function to determine when the payoff has completed after the end of each game.

Annex 6

The card game monitoring system mentioned above, the control unit has a transmitting function to transmit the information of the monitor video camera to a backyard in casino.

Annex 7

The card game monitoring system mentioned above, the control unit has a determination function to determine an error, and the card game monitoring system further has an output means to output an error signal by displaying and/or alarming in the card shooter apparatus and/or the related system components incorporated in the card game monitoring system as a result of the determination of the error. The error mentioned above includes at least one of the following items: 1) The ranks of playing cards identified by the card game monitoring system on the game table delivered by the dealer are not same as the ones determined by the card shooter apparatus; 2) Wagers have moved from the original betting position to other areas during each game; and 3) Wagers with payoffs have not moved to the winners of the bettors at the end of each game.

Annex 8

The card game monitoring system mentioned above, the control unit has a determination function to identify a cut card delivered from the card shooter apparatus.

The invention claimed is:

1. A monitoring system for a game in which one or more bettors place one or more bets, the monitoring system comprising:

a game table including betting areas;

a card shooter apparatus including a card reader configured to read ranks of cards;

a camera system configured to:

identify the one or more bets; and for each of the one or more bets, determine which betting area of the betting areas the bet is on; and a control unit configured to determine:

numbers and positions of betting chips based on an output of the camera system;

whether each bettor of the one or more bettors is dealt more than two cards by a dealer from the card shooter apparatus;

contents of each hand of the one or more bettors and contents of a dealer hand according to the ranks read by the card reader, the hands being formed by a subset of one or more of the cards;

one or more winners of the game based on predefined game rules, the hands of the one or more bettors, and the dealer hand;

and based on a determination that the bettor of the one or more bettors is a winning bettor, that a corresponding payoff is correctly paid to the winning bettor by placing chips from a chiptray into a region of the game table corresponding to the winning bettor.

2. The monitoring system according to claim 1, wherein the control unit is further configured to:

identify ranks of the cards on the game table dealt by the dealer; and verify that the ranks of the dealt cards are identical to the ranks of the cards read by the card reader.

3. The monitoring system according to claim 1, wherein the control unit is further configured to determine when the game starts and when the game ends.

4. The monitoring system according to claim 3, wherein the control unit is further configured to determine if a bet is moved from a first betting area of the betting areas to a second betting area of the betting areas during the game, the first betting area different from the second betting area.

5. The monitoring system according to claim 1, wherein:

the camera system is further configured to detect a direction of movement of the one or more bets on the game table, and the control unit is further configured to verify that the payoff corresponding to the winning bettor is received by the winning bettor, the winning bettor corresponding to one of the hands identified as a winning hand at the end of the game.

6. The monitoring system according to claim 1, wherein the camera system is further configured to capture positions of the cards delivered from the card shooter apparatus to the one or more bettors.

7. The monitoring system according to claim 1, wherein the control unit determines the numbers of the betting chips by counting the chips.

8. The monitoring system according to claim 1, wherein the control unit is configured to determine the numbers and positions of the betting chips based on images captured by the camera system.

9. The monitoring system according to claim 8, wherein the control unit is further configured to determine the numbers and positions of the betting chips based on a total height of the betting chips positioned within the betting areas and a color of each chip positioned within the betting areas.

10. The monitoring system according to claim 1, wherein the control unit is configured to determine a chip amount corresponding to a bettor of the one or more bettors by determining chips corresponding to the bettor based on a position of the chips within a betting area corresponding to the bettor.

11. The monitoring system according to claim 10, wherein the control unit is configured to determine the chip amount corresponding to the bettor by counting the chips within the betting area corresponding to the bettor.

12. The monitoring system according to claim 10, wherein the control unit is further configured to determine a total value of chips on a table based on one or more determinations of the chip amount corresponding to each bettor of the one or more bettors.

13. The monitoring system according to claim 1, wherein the camera system includes a first image capture device configured to capture an image from above and at an angle so that the image includes one or more chips positioned on a first betting area of the betting areas.

14. The monitoring system according to claim 13, wherein the camera system includes a second image capture device configured to capture an image horizontally so that the image includes a side of the one or more chips positioned on the first betting area of the betting areas.

15. A card game monitoring system for a game in which one or more bettors place one or more bets, the card game monitoring system comprising:

a game table including betting areas corresponding to a banker hand and betting areas corresponding to a player hand;

a card shooter apparatus configured to read ranks of each card as the cards are dealt;

a camera system configured to detect the one or more bets when the one or more bets are on the game table; and a control unit configured to:

based on the detection by the camera system, determine, for each of the one or more bets, whether the respective bet is on the betting areas corresponding to the banker hand or on the betting areas corresponding to the player hand;

determine whether a winning hand of the game is the banker hand or the player hand based on predefined game rules and the ranks of the dealt cards, the winning hand being formed by a subset of the dealt cards; and determine whether any of the one or more bettors is a winning bettor based on one of the one or more bets corresponding to the bettor of the one or more bettors, the one of the one or more bets detected as being on a betting area corresponding to the winning hand; and based on one of the one or more bettors being a winning bettor, determine whether a corresponding payoff is correctly paid to the winning bettor after the game is recognized by the control unit as having ended by placing chips from a chiptray into a region of the game table corresponding to the winning bettor.

16. The card game monitoring system according to claim 15, wherein the control unit is further configured to identify the ranks of the cards on the game table and verify whether the ranks of the cards on the game table are the same as those read by the card shooter apparatus.

17. The card game monitoring system according to claim 15, wherein the card shooter apparatus is configured to determine when the game starts and when the game ends.

18. The card game monitoring system according to claim 17, wherein the control unit is further configured to verify that a first bet does not move from a first betting area to a second betting area during the game, the first betting area different from the second betting area.

19. The card game monitoring system according to claim 15, wherein the camera system is further configured to identify the cards.

20. A monitoring system comprising:

a camera system configured to capture images that include one or more chips positioned on a game table including one or more betting areas;

a control unit configured to receive the captured images from the camera system and, based on the captured images, determine:

a position of a set of betting chips of one or more sets of betting chips, the set of betting chips corresponding to one bettor of one or more bettors;

based on the position of the set of betting chips, a betting area of the one or more betting areas corresponding to the position of the set of betting chips; and a number of betting chips included within the set of betting chips.

21. The monitoring system according to claim 20, further comprising a card reader configured to read ranks of cards dispensed from a card shooter.

22. The monitoring system according to claim 21, wherein the control unit is further configured to determine:

based on information received from the card shooter:

a dealer hand corresponding to the dealer;

a bettor hand corresponding to each bettor of the one or more bettors;

one or more winning hands based on game rules, each winning hand of the one or more winning hands corresponding to a comparison between the dealer hand and each bettor hand of the one or more bettors;

based on the captured images from the camera system:

whether a dealer has dealt more than two cards to a bettor from the card shooter; and whether, for each bettor of the one or more bettors and based on the determination of the one or more winning hands, chips have been received or removed from a chiptray of the game table.

23. The monitoring system according to claim 20, wherein the camera system including an image capture device configured to capture the images from above and at an angle so that the images include the one or more chips positioned on the game table including the one or more betting areas.

* * * * *